US005857563A

United States Patent [19]

Helmer et al.

[11] Patent Number: 5,857,563

[45] Date of Patent: Jan. 12, 1999

[54] ACTUATOR FOR REMOTELY OPERATED CIRCUIT BREAKERS

[75] Inventors: Clifford Randy Helmer, Fulton; Lawrence Carl Lindsey, Tully, both of N.Y.

[73] Assignee: Cooper Industries, Inc., Houston, Tex.

[21] Appl. No.: 994,048

[22] Filed: Dec. 19, 1997

[51] Int. Cl.[6] ..... H01H 3/00

[52] U.S. Cl. ..... 200/332.1

[58] Field of Search ..... 200/1 R, 7 R, 200/18, 401, 500, 501, 329–337, 50.01, 50.06, 16 R, 572, 573

[56] References Cited

U.S. PATENT DOCUMENTS

| | | | |
|---|---|---|---|
| 4,131,776 | 12/1978 | Ehrenberger | 200/158 |
| 4,873,404 | 10/1989 | Fritsch | 200/332 |
| 5,111,009 | 5/1992 | Chan et al. | 200/330 |
| 5,286,935 | 2/1994 | Mina et al. | 200/330 |
| 5,362,933 | 11/1994 | Kutsche et al. | 200/401 |
| 5,387,770 | 2/1995 | Ikehata et al. | 200/17 R |
| 5,577,603 | 11/1996 | Bogdanovs et al. | 200/331 |

OTHER PUBLICATIONS

Appleton Electronic Company; Oct. 1993. p. 3.

*Primary Examiner*—Michael A. Friedhofer
*Attorney, Agent, or Firm*—Burns, Doane Swecker & Mathis LLP

[57] ABSTRACT

A circuit breaker panelbox includes a circuit breaker receiving area for receiving a plurality of circuit breakers; a sliding arm for each of the plurality of circuit breakers, each of the sliding arms including a device for engaging a toggle switch of the respective circuit breaker; a frame for supporting the sliding arms such that the sliding arms can slide with respect to their respective circuit breakers; first and second contacts on each of the sliding arms at spaced locations; and an actuator for each of the sliding arms, the actuator including a device for contacting one of the first and second contacts of the respective sliding arm in order to actuate the respective circuit breaker.

14 Claims, 4 Drawing Sheets

FIG. 1
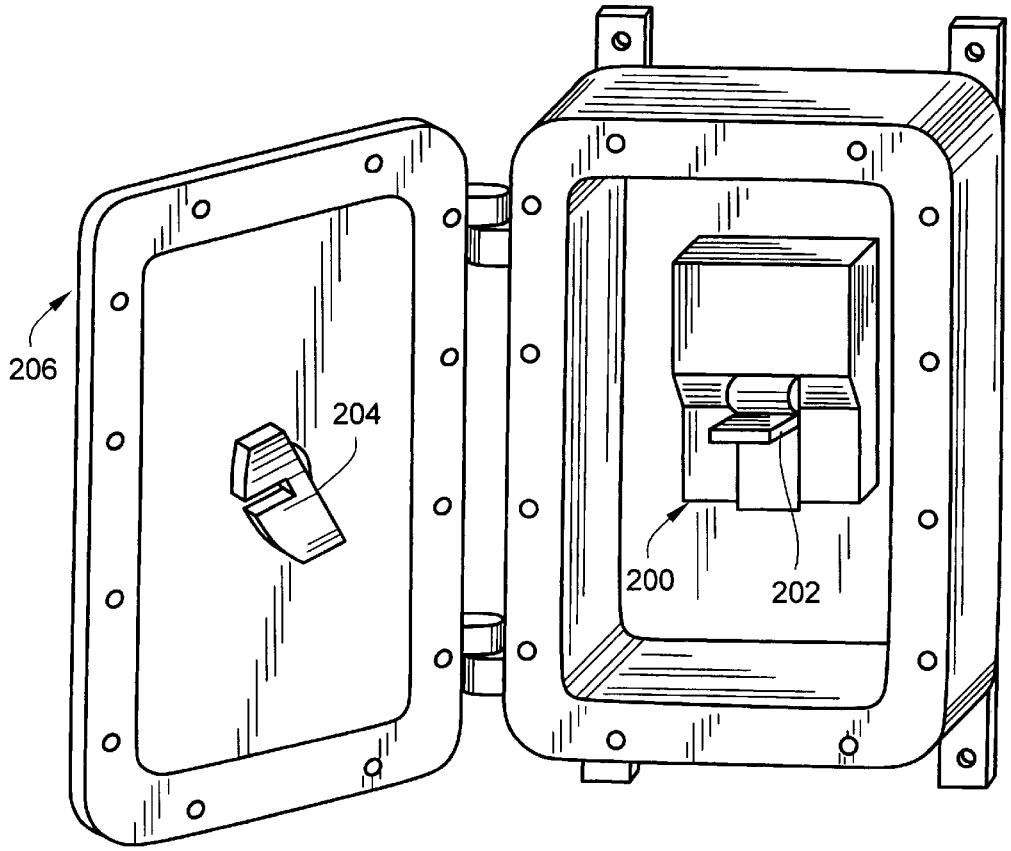
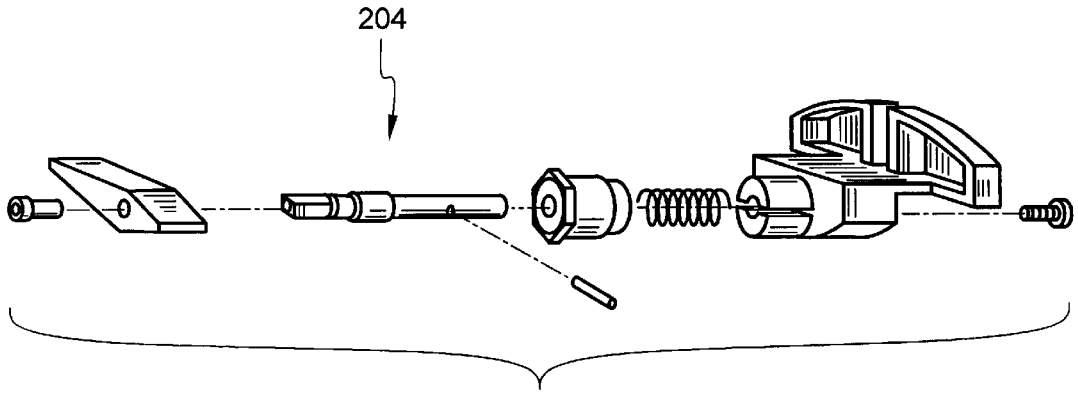
FIG. 2

ACTUATOR FOR REMOTELY OPERATED CIRCUIT BREAKERS

BACKGROUND OF THE INVENTION

1. Field of the Invention

The present invention relates to an actuator for a circuit breaker, and in particular, for an actuator enabling remote actuation of the circuit breaker.

2. Description of Related Art

Remote actuators for circuit breakers are known in the prior art. For example, U.S. Pat. No. 5,577,603 discloses a remote operator for manipulating a toggle of a circuit breaker. The disclosed remote operator enables operation of a circuit breaker within a panel box by a lever extending through a door of the panel box. However, a problem with the prior art remote actuators is that, prior to the present invention, such actuators were not able to be used with narrow circuit breakers that were arranged close together. The closeness of the devices caused difficulty in gripping and operating the correct handle, and only the correct one, particularly with gloved hands.

Another prior art method of remotely operating circuit breakers has been the use of linear actuated shafts. However, such a device has been found to be subject to contamination and thus binding or jamming in field use.

Another method of remotely actuating circuit breakers has been the use of wire in/wire out breakers, rather than chassis mounted breakers. This method permits wider separation of breakers, and the staggering of operators. However, such a method requires additional wire, additional room, and additional labor for wiring the system, as opposed to a simple chassis mounted arrangement.

OBJECTS AND SUMMARY

An object of the present invention is to provide a system for remotely operating circuit breakers that can be used with narrow circuit breakers arranged adjacent each other.

Another object of the present invention is to enable rotary remote operators to be used on circuit breakers arranged in close proximity to each other.

According to the present invention, an actuator for a circuit breaker includes a sliding arm having means for engaging a toggle switch of the circuit breaker, a frame for supporting the sliding arm such that the sliding arm can slide with respect to the circuit breaker, at least two contacts on the sliding arm at spaced locations, and actuating means for contacting only one of the at least two contacts in order to actuate the circuit breaker.

The present invention also contemplates a circuit breaker panel box that includes a circuit breaker receiving area for receiving a plurality of circuit breakers, a sliding arm for each of the plurality of circuit breakers, each of the sliding arms including means for engaging a toggle switch of the respective circuit breaker, a frame for supporting the sliding arms such that the sliding arms can slide with respect to their respective circuit breakers, first and second contacts on each of the sliding arms at space locations, and an actuating means for each of the sliding arms, the actuating means including means for contacting one of the first and second contacts of the respective sliding arm in order to actuate the respective circuit breaker.

BRIEF DESCRIPTION OF THE DRAWINGS

FIG. 1 is a perspective view of a prior art circuit breaker and circuit breaker actuator arrangement;

FIG. 2 is an exploded view of the actuator used in the arrangement of FIG. 1;

DETAILED DESCRIPTION OF THE PREFERRED EMBODIMENTS

Figure 3:
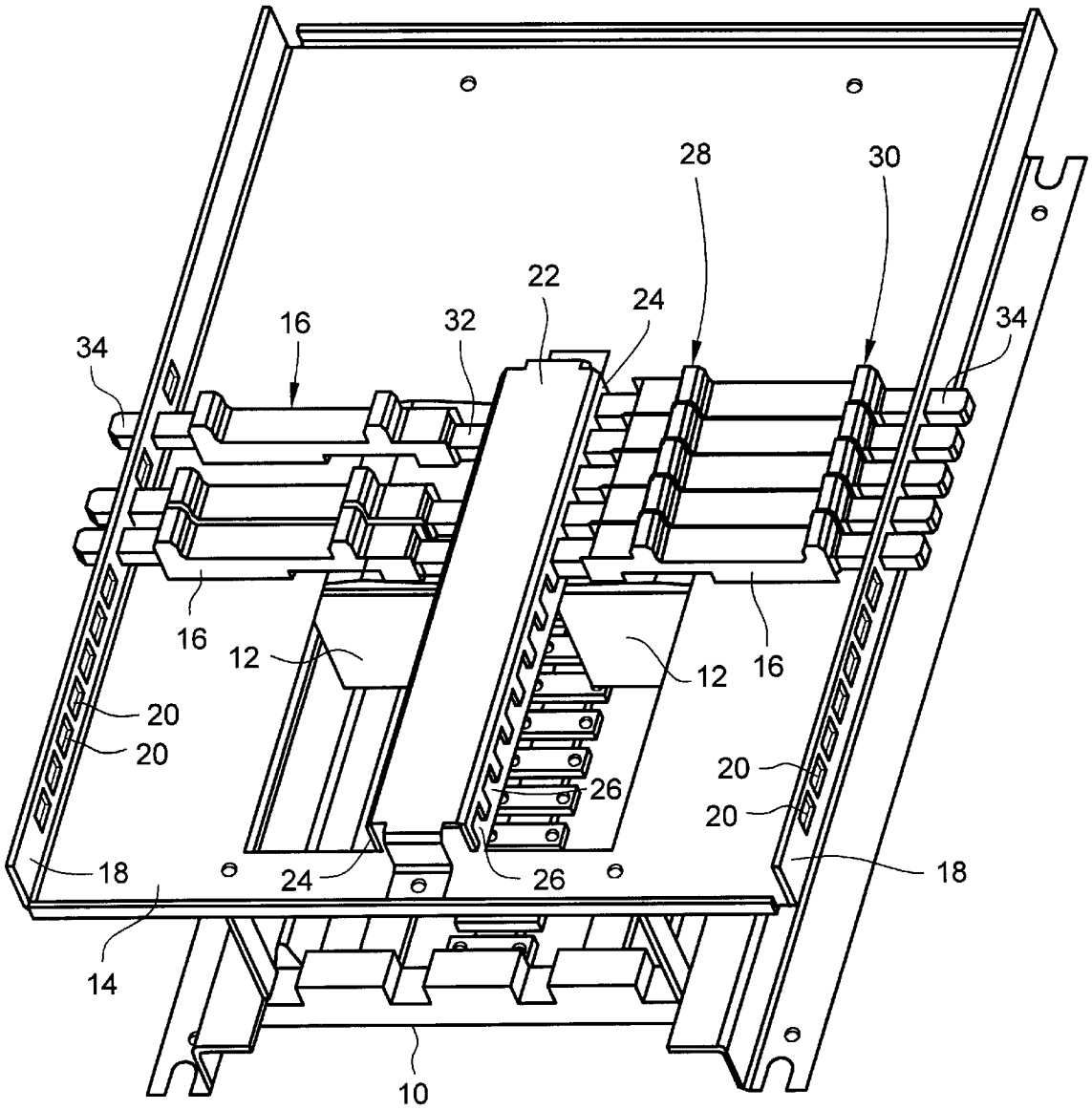
FIG. 3 is a perspective view of a panel box including a plurality of circuit breakers and slider arms according to an embodiment of the present invention.

FIGS. 1 and 2 illustrate a remote, self-adjusting operator for an electrical enclosure that has been described and claimed in U.S. Pat. No. 5,577,603. The subject matter of U.S. Pat. No. 5,577,603 is incorporated herein by reference. According to this prior art, one end of the actuator 204 engages with the toggle switch 202 of the circuit breaker 200 that is arranged in an electrical enclosure. The actuator 204 extends through the door 206 of the electrical enclosure so that the actuator 204 may be used to actuate the toggle switch 202 of the circuit breaker 200 when the door 206 is closed. A disadvantage of this arrangement is that the actuators 204 must be spaced from each other a sufficient distance to enable rotation of the actuator 204 without interference with an adjacent actuator 204.

Turning attention now to FIGS. 3–6, an embodiment of the present invention is illustrated which overcomes the aforementioned disadvantage of the prior art.

In FIG. 3, a panel interior or chassis 10 is illustrated with a plurality of circuit breakers 12. In order to provide sufficient spacing for actuators, a frame 14 is secured on the panel box 10 above the circuit breakers 12.

The frame 14 includes outer walls 18. Each of the outer walls 18 includes a plurality of openings 20. The openings 20 are preferably spaced uniformly from each other at a distance that is comparable to the spacing of the circuit breakers 12.

In the center of the frame 14 is a center box 22 that includes opposing walls 24. Each of the walls 24 includes a plurality of openings 26 that are arranged in alignment with the openings 20 of the outside walls 18. For each of the circuit breakers 12, a slider arm 16 is provided so as to provide engagement with a respective actuator.

Figure 4:
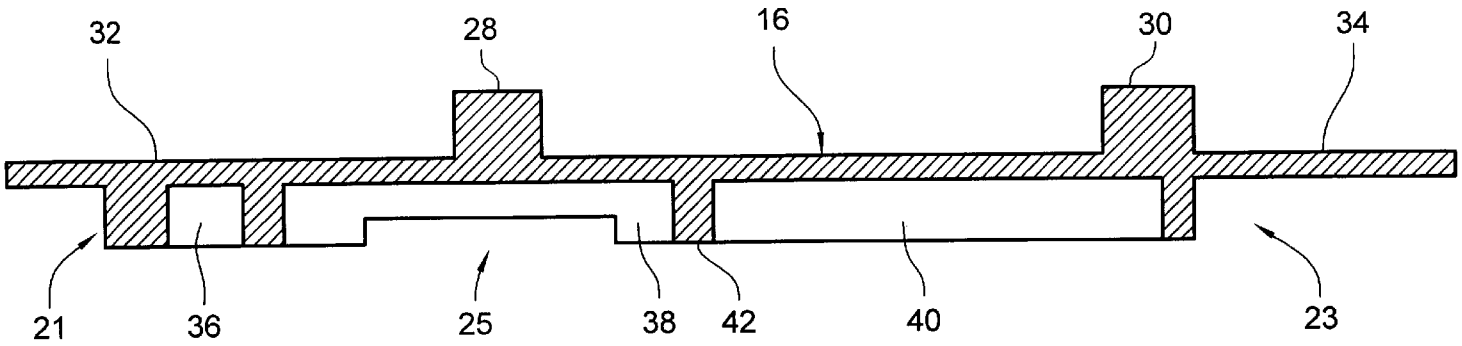
FIG. 4 is a cross-sectional view, taken along line 4—4 of FIG. 5, of a slider arm according to an embodiment of the present invention.
Figure 5:
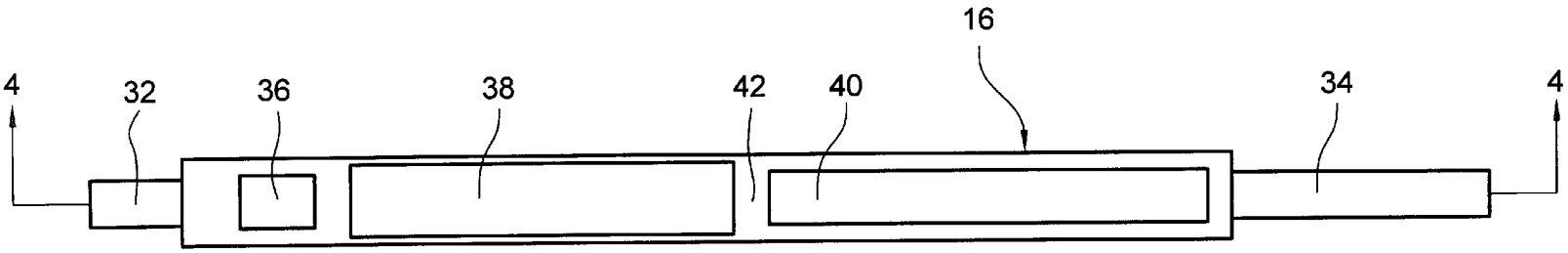
FIG. 5 is a bottom view of a slider arm according to an embodiment of the present invention.

FIGS. 4 and 5 illustrate a slider arm 16 in detail. At a first end 21 of the slider arm 16, a recess 36 is provided on the underside 25 of the slider arm 16. The first end 21 of the slider arm 16 also includes a first tab 32 for engagement with a respective opening 26 in the center box 22. At the opposite, or second, end 23 of the slider arm 16 is a second tab 34 which is designed for engagement with a respective opening 20 in one of the outer walls 18 of the frame 14.

Recess 38 is to clear any additional projections from the top of the circuit breakers. Recess 40 is to conserve plastic and maintain uniform wall thickness. A reinforcing rib 42 may be used across a mid-section of the underside 25 of the slider arm 16.

Although the slider arm 16 may be made of any material suitable for this application, as can be easily determined by one of ordinary skill in this art, in a preferred embodiment, the slider arm 16 is made out of acetal, which affords a smooth and constant operation without lubrication.

Figure 6:
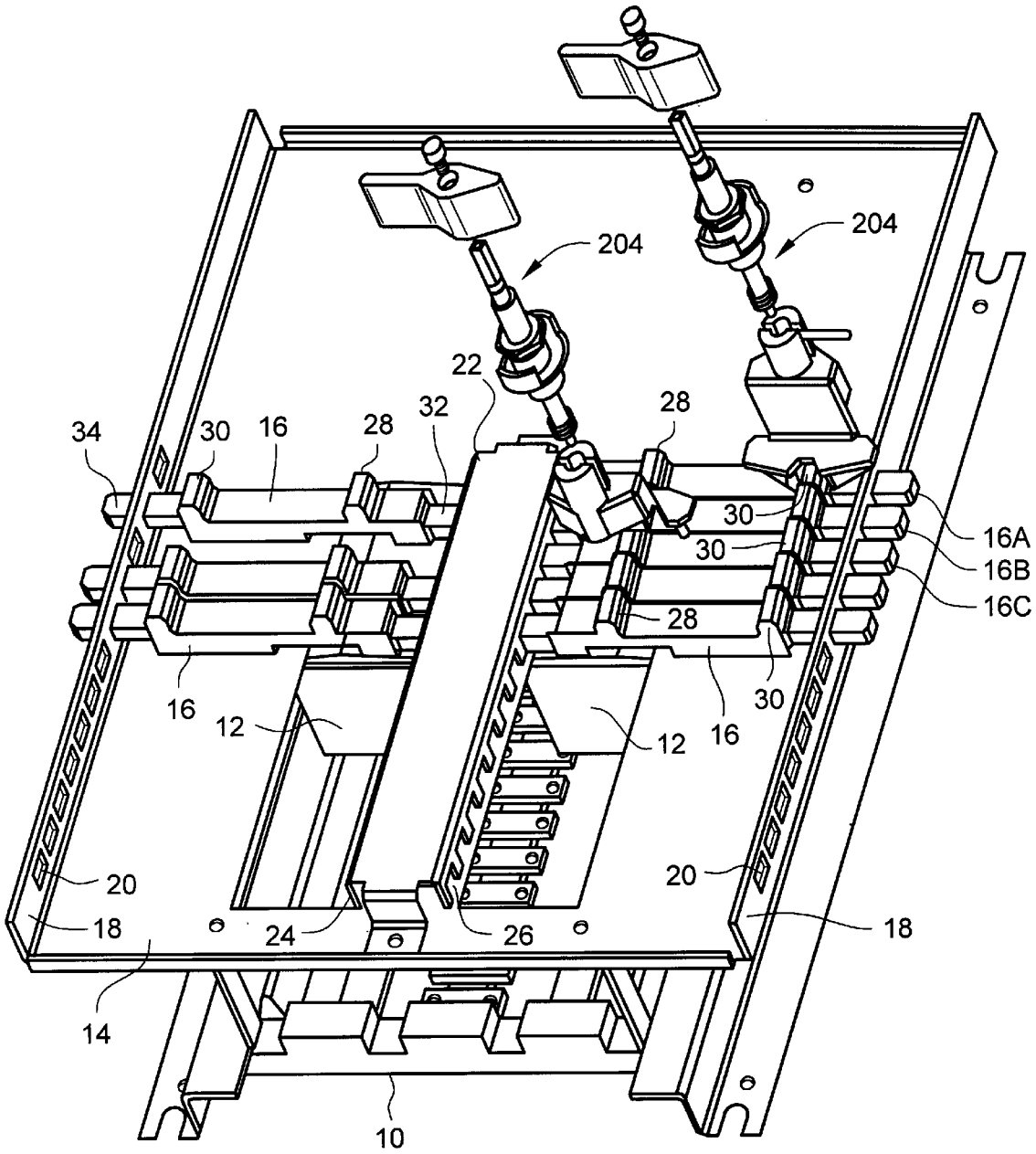
FIG. 6 is a perspective view of a panel box including actuators according to an embodiment of the present invention.

Turning attention now to FIG. 6, a panel box 10 including a plurality of circuit breakers 12 is illustrated. Each of the circuit breakers 12 has a respective slider arm 16 mounted between the outer walls 18 and the center box 22 of the frame 14. The openings 20, 26 permit a sliding movement of the slider arms 16 across the frame 14, with respect to the circuit breakers 12.

Although not clearly illustrated in the figure, the recess 36 of each of the slider arms 16 is mounted over the toggle switch of the respective circuit breaker 12 so as to engage the toggle switch within the recess 36. In this manner, a sliding movement of the slider arm 16 can be used to actuate the toggle switch. In order to manipulate the slider arm 16, each slider arm 16 is provided with a respective actuator 204.

Although not illustrated in FIG. 6, each of the actuators 204 is preferably mounted in a cover or door for enclosing the panel chassis 10, as illustrated in FIG. 1 of this application.

In order to enable a compact arrangement of circuit breakers 12, the actuator 204 for a first circuit breaker (beneath slider arm 16A) is mounted in alignment with and engaged with the second projection 30 of the slider arm 16A. The actuator 204 for the next adjacent circuit breaker (beneath slider arm 16B) is mounted in alignment with and engaged with the first projection 28 of the respective slider arm 16B.

Although not illustrated in FIG. 6, the actuator 204 for the next circuit breaker (beneath slider arm 16C) is mounted in alignment with and engaged with the second projection 30 of the slider arm 16C. By alternatingly arranging the actuators 204 with respect to the first and second contacts or projections 28, 30 of the slider arms 16, the slider arms 16 and respective circuit breakers 12 can be arranged in a more compact space than would otherwise be possible.

Although not specifically illustrated in the figures, the present invention may contemplate an alternative embodiment, wherein there are more than two projections extending from a top surface of each of the slider arms 16. Even in this alternative embodiments, the respective actuator would engage with only one of the projections. Such multiple projections may provide more flexibility in the location and arrangement of the actuators for the circuit breakers.

Although only preferred embodiments are specifically illustrated and described herein, it will be appreciated that many modifications and variations of the present invention are possible in view of the above teachings and within the purview of the appended claims without departing from the spirit and intended scope of the invention.

What is claimed is:

1. An actuator for a circuit breaker, comprising:

a sliding arm having means for engaging a toggle switch of the circuit breaker;

a frame for supporting the sliding arm such that the sliding arm can slide with respect to the circuit breaker;

at least two contacts on the sliding arm at spaced locations; and actuating means for contacting only one of the at least two contacts in order to actuate the circuit breaker.

2. The actuator of claim 1, wherein the engaging means includes a recess in a bottom surface of the sliding arm.

3. The actuator of claim 2, wherein each of the contacts is a projection extending from a top surface of the sliding arm.

4. The actuator of claim 1, wherein the frame includes a first opening for receiving a first end of the sliding arm and a second opening for receiving a second end of the sliding arm.

5. The actuator of claim 1, wherein each of the contacts is a projection.

6. A circuit breaker panel box, comprising:

a circuit breaker receiving area for receiving a plurality of circuit breakers;

a sliding arm for each of the plurality of circuit breakers, each of the sliding arms including means for engaging a toggle switch of a respective circuit breaker;

a frame for supporting the sliding arms such that the sliding arms can slide with respect to their respective circuit breakers;

first and second contacts on each of the sliding arms at spaced locations; and an actuator for each of the sliding arms, the actuator including means for contacting one of the first and second contacts of the respective sliding arm in order to actuate the respective circuit breaker.

7. The actuator of claim 6, wherein the frame includes a plurality of first openings for receiving a first end of each of the sliding arms and a plurality of second openings for receiving a second end of each of the sliding arms.

8. The actuator of claim 7, wherein the receiving area includes space for two parallel rows of circuit breakers and the second openings of the frame are arranged between the two parallel rows.

9. The circuit breaker panel box of claim 6, wherein:

at least some of the sliding arms are arranged adjacent each other in parallel, the first contacts of the at least some of the sliding arms are arranged in a first row and the second contacts of the at least some of the sliding arms are arranged in a second row, and the actuating means for every other of the at least some of the sliding arms are aligned so as to engage the first contact of the respective sliding arm and the actuating means for the remaining of the at least some of the sliding arms are aligned so as to engage the second contact of the respective sliding arm.

10. The actuator of claim 9, wherein the frame includes a plurality of first openings for receiving a first end of each of the sliding arms and a plurality of second openings for receiving a second end of each of the sliding arms.

11. The actuator of claim 9, wherein each of the contacts is a projection.

12. The actuator of claim 6, wherein the engaging means of each of the sliding arms includes a recess in a bottom surface of each of the sliding arms.

13. The actuator of claim 12, wherein each of the contacts is a projection.

14. The actuator of claim 6, wherein each of the contacts is a projection.

* * * * *